United States Patent [19]

Stahlecker et al.

[11] Patent Number: 4,462,558

[45] Date of Patent: Jul. 31, 1984

[54] YARN PACKAGE AND METHOD AND APPARATUS FOR PRODUCING THE SAME

[75] Inventors: Gerd Stahlecker, Geislingen-Stötten; Hans Braxmeier, Suessen, both of Fed. Rep. of Germany

[73] Assignees: Fritz Stahlecker; Hans Stahlecker, both of Fed. Rep. of Germany

[21] Appl. No.: 471,514

[22] Filed: Mar. 2, 1983

[30] Foreign Application Priority Data

Mar. 18, 1982 [DE] Fed. Rep. of Germany ..... 3209847

[51] Int. Cl.[3] ..... B65H 55/00; B65H 55/04; B65H 54/32

[52] U.S. Cl. ..... 242/178; 242/26.3; 242/158.2; 242/158.4 R

[58] Field of Search ..... 242/178, 174, 175, 176, 242/177, 26.3, 26.2, 26.1, 43.2, 158 R, 158.2, 158.4 R, 158.4 A

[56] References Cited

U.S. PATENT DOCUMENTS

| | | | |
|---|---|---|---|
| 2,285,438 | 6/1942 | Jones | 242/178 |
| 2,296,420 | 9/1942 | Campbell | 242/177 |
| 2,749,055 | 6/1956 | Bauer | 242/26.2 |
| 2,764,363 | 9/1956 | Stammwitz | 242/26.2 |
| 3,367,588 | 2/1968 | Wolf | 242/26.3 |
| 3,445,073 | 5/1969 | Schippers et al. | 242/26.3 |

FOREIGN PATENT DOCUMENTS

| | | | |
|---|---|---|---|
| 1800526 | 5/1970 | Fed. Rep. of Germany | 242/174 |
| 42-2607 | 2/1967 | Japan | 242/26.3 |
| 534735 | 3/1941 | United Kingdom | 242/178 |
| 2029459 | 3/1980 | United Kingdom | 242/178 |

*Primary Examiner*—Stanley N. Gilreath
*Attorney, Agent, or Firm*—Bell, Seltzer, Park & Gibson

[57] ABSTRACT

A yarn package and a method and apparatus for producing the same are disclosed, and wherein the package is composed of a yarn wound in layers of decreasing axial length so as to define a central cylindrical portion and opposite end portions. In order to protectively shield the exposed ends of the yarn layers within at least one of the tapered end portions, the outermost layer is extended so as to overlie and entirely cover such one tapered end portion. In addition, selected intermediate yarn layers may be extended axially a distance sufficient to overlie and cover essentially all of the underlying layers on such one end portion to protect and stabilize the underlying yarn layers.

13 Claims, 5 Drawing Figures

Fig. 1
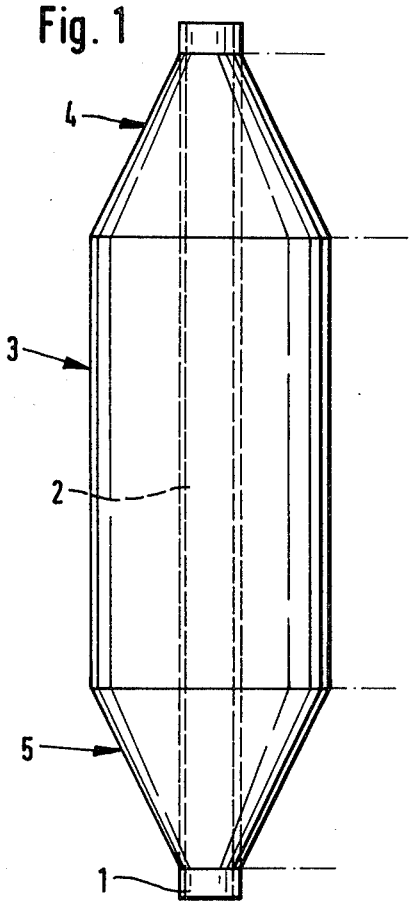
Fig. 3
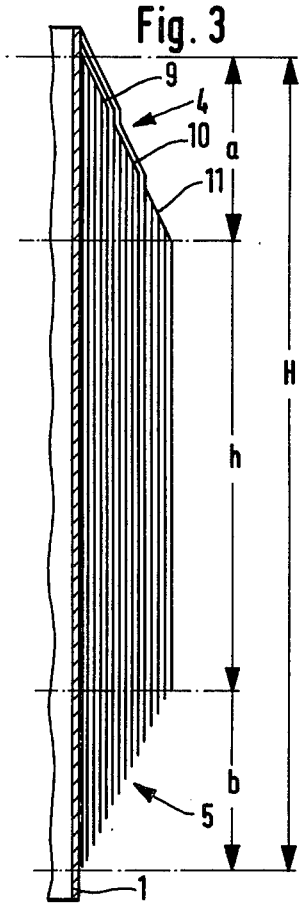
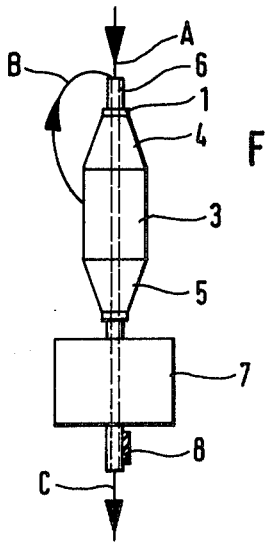
Fig. 2

YARN PACKAGE AND METHOD AND APPARATUS FOR PRODUCING THE SAME

The present invention relates to a yarn package, and a method and apparatus for producing the same. The yarn package of the invention finds particular utility as the supply package for the binding yarn in the production of a wrapped or covered yarn.

Wrapped or covered yarns are presently produced by a process wherein a binding yarn package is mounted on a hollow spindle, and a base yarn or sliver is continuously advanced through the spindle. The spindle and binding yarn package are rotated at high speed, and the binding yarn is withdrawn from the package and fed into the entry end of the hollow spindle so as to be helically wrapped about the advancing base yarn during its movement through the spindle.

Binding yarn packages of the above type conventionally comprise a tubular yarn carrier, with a filament yarn wound upon the carrier in parallel layers, and with the axial length of the individual layers steadily decreasing so that the package is composed of a central cylindrical portion which is coaxial with the tube, and opposite tapered end portions.

As will be apparent, the ends of all of the yarn layers within a package of the described type are exposed along each of the tapered end portions. There thus exists a risk that careless handling during transportation, storage, or creeling can result in such exposed ends of the yarn layers being damaged or disarranged, so that use of the package is rendered difficult if not impossible.

It is accordingly an object of the present invention to provide a yarn package, and a method and apparatus for producing the same, wherein the exposed ends of the yarn layers along at least one of the tapered end portions of the package are effectively protected against damage or disarrangement.

The above and other objects and advantages of the present invention are achieved in the embodiment illustrated herein by the provision of a yarn package which comprises a cylindrical carrier having a yarn wound thereupon in layers of decreasing axial length so as to define a central cylindrical portion and tapered end portions, and wherein the outermost yarn layer extends over substantially the entire axial length of the central portion and at least one of the tapered end portions so as to protectively overlie the same. By this arrangement, the outer surface of the yarn package is composed of a single layer of wound yarn over the greatest part of its length, so that in the event this outermost layer is damaged, the entire package will not become useless. Thus, only the outermost layer would need to be unwound and discarded prior to the package being utilized in a wrap or cover yarn spinning operation or the like.

It has been shown that when wound yarn packages of the described type are used to supply the binding yarn in a wrap or cover yarn spinning operation, a disarrangement of the yarn within the layers, particularly in its tapered end portion, can lead to an impairment of the spinning process. In order to prevent the layers of the binding yarn from becoming disarranged in this tapered end portion, it is further provided in accordance with a specific embodiment of the present invention that the winding lengths of several, regularly spaced apart intermediate layers extend axially so as to overlie the central portion and at least one tapered end portion. The tapered end portion of the package is thereby stabilized.

It should also be noted that when the package is used on a wrap or cover yarn spinning machine, the package supplying the binding yarn is placed on a hollow spindle which may be rotated at speeds from 20,000 to 30,000 rpm, and that the yarn is withdrawn from the rotating package in the form of a yarn balloon, and the yarn which is being unwound may possibly contact the tapered end portion over which it is unwound. Since in accordance with the above described embodiment of the invention, the tapered end portion is covered at intervals by an extended intermediate layer, a contact of the yarn balloon will not lead to an abrasion of the wound filament yarn since the yarn wound on the tapered end portion is withdrawn in regular intervals to expose the underlying untouched layers of yarn.

To insure that only the outer layers in the tapered end portion are exposed, it is further provided that each of the extended intermediate yarn layers which cover the one end portion has a greater axial length than the next adjacent underlying one of such extended intermediate layers and so that each of such intermediate layers overlies and entirely covers the ends of the underlying layers on such one end portion. Thus it is insured that none of the inner layers are exposed in the tapered end portion.

Some of the objects of the invention having been stated, other objects and advantages will become apparent as the description proceeds, when taken in connection with the accompanying drawings, in which FIG. 1 is a side elevational view of a yarn package which embodies the features of the present invention;

FIG. 2 is a schematic view illustrating the use of the package of the present invention as a binding yarn in a wrap or cover yarn spinning machine;

FIG. 3 is an axial sectional view of the package shown in FIG. 1, with a schematic illustration of the arrangement of the individual layers of the filament yarn;

Figure 4:
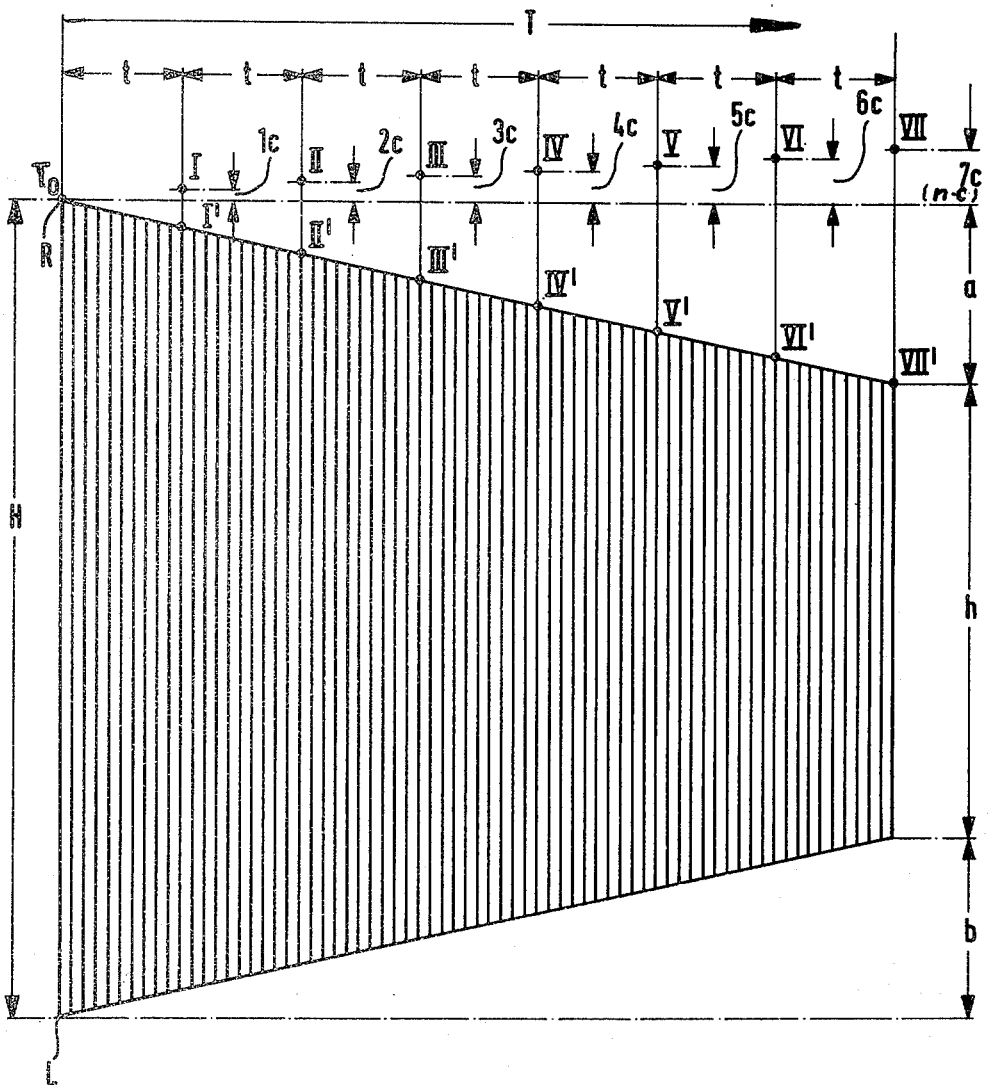
FIG. 4 is a diagram illustrating the traverse strokes performed during the winding process, wherein a yarn package is produced in accordance with the present invention.

Referring more particularly to the drawings, a filament yarn package which embodies the features of the present invention is shown in FIG. 1, and comprises a hollow cylindrical carrier 1, upon which a filament yarn is wound. The filament yarn comprises for example a very fine denier yarn, of the type used as a binding yarn in a cover yarn spinning operation. The filament yarn is wound on the carrier 1 in parallel layers, and is densely packed in juxtaposed windings in such a manner that it forms a central cylindrical portion 3 which is coaxially disposed about the axis of the tube. In addition, at both ends, there is formed a tapered end portion 4 and 5. The two tapered portions 4 and 5 can, but need not, have the same angular inclination.

FIG. 2 illustrates a cover yarn spinning apparatus which utilizes the package as described above. The apparatus includes a hollow spindle 6, upon which the carrier 1 of the package is mounted. The spindle 6 is mounted in a bearing housing 7, and its end projects beyond the bearing housing and is driven by a tangential belt 8. The filament yarn serving as the binding yarn B enters into hollow spindle 6, together with a base yarn or sliver A coming from a drafting system. As it does so, the binding yarn is wrapped around the sliver A so that a covered yarn C is produced, which passes through the spindle 6 and is wound on a cross wound package (not shown). The package is rotatingly secured to the hollow spindle 6 so as to rotate with the spindle, and the binding yarn B is unwound upwardly in the form of a yarn balloon. To maintain proper spinning conditions, it is important that the build of the yarn on the carrier is not disrupted, and that the yarn B may be unwound uniformly. In this regard, when the binding yarn B is unwound there is a risk that it may contact at least temporarily the tapered end portion 4 and slip along the surface thereof. If this slipping motion continues for a period of time, or occurs regularly at the same place, there is a risk that the wound filament yarn may be broken.

In order to protect the tapered end portion 4 over which the filament yarn is unwound, a special build of the package is provided, as best illustrated in FIG. 3. The winding of the filament yarn on the carrier 1 starts on the carrier surface over an axial length H. The yarn is wound in dense layers, and the axial length of each layer is steadily reduced as the distance from the carrier increases and so that the wound package builds as illustrated, to form a central cylindrical portion 3 with an axial length h and two tapering portions 4 and 5 with axial lengths a and b, respectively. The winding lengths of portions 4 and 5 need not be shortened identically, and thus the lengths a and b may be different. In order to particularly protect tapered portion 4, it is provided that the winding length is increased in regular intervals, preferably after every twentieth yarn layer, so that the portion 4 is covered by the same layer of yarn. This is illustrated in FIG. 3, by an extended layer of yarn indicated at 9. At this point, the winding proceeds in such a manner that the ends of the underlying yarn layers in portion 4 are completely covered, i.e., the winding length H is increased by approximately the thickness or diameter of the filament yarn. As illustrated by the yarn layer 10, this procedure repeats at regular intervals, in which the portion formed by the yarn layer 9 and the later wound layers are covered. The winding length is then again increased by an extent so that all underlying layers are completely covered, i.e., by at least the amount of the yarn thickness above the preceding increased winding length. In corresponding manner, the outermost layer, which is indicated at 11, is wound over portion 4 and its underlying layers. At this point, it is suitable to wind layer 11 also over the other tapering portion 5 (not shown in FIG. 3), so that the outside surface of the wound package is completely formed by the outermost layer of the filament yarn. In the event that the outside surface of the package is damaged, it is then necessary only to unwind the outermost layer, after which the entire package may be used. The extended intermediate layers 9 and 10 which are overwound in portion 4, lead to a stabilization of the individual layers, so that at high speeds, and when the binding yarn B is unwound at high speed, no difficulty will arise in this area. Naturally, it is possible to also cover tapering end portion 5 by winding in a corresponding manner extended intermediate layers of yarn over this portion, however, practice has shown that this portion is less endangered, and that to avoid damage during transportation, it is sufficient to only wind the outermost layer over this portion 5.

Typically, a filament yarn is wound on a carrier 1 by means of a traversing yarn guide which moves in traversing strokes along a direction parallel to the axis of the tube. The diagram in FIG. 4 shows the manner in which the traverse strokes may be carried out so as to obtain a yarn package according to the invention. Proceeding from the initial traverse stroke H, the traverse strokes are shown over a period of winding T. At the point of time To, the traverse stroke H is defined by a right hand reversal point R and a left hand reversal point L, which move toward each other as the period of winding progresses. Thus the package develops to the structure shown in FIGS. 1 and 3. After a predetermined number t of yarn layers have been produced, the traverse stroke is axially extended on at least one side in such a manner that on this side the underlying tapered portion is over wound by an extension of the layer. To this effect, the traverse stroke is lengthened by the distance between I and I', which includes a small amount c beyond the initial reversal point on such side, i.e., beyond the right hand reversal point R in the illustrated embodiment. The lengthened distance c equals at least the thickness of the filament yarn being wound. Winding then again proceeds according to the foregoing winding pattern, i.e., the stroke returns to the reduced length.

The above process for producing an increased winding length repeats after another predetermined amount t of layers has been wound, with a further extension of the layer being wound in comparison with the preceding increased stroke by the amount c, so that this second extended stroke is lengthened by an amount 2c beyond the initial reversal point R. In a corresponding manner, this procedure repeats in regular intervals until the oucermost layer is wound. The axial traverse length of each extended stroke may thus be defined as equalling $(h+a+n\times c)$, with n representing the number of the extended stroke. Since the yarn cross sections are very small, it is possible to plan a lengthened traverse stroke at regular time intervals, which may be related to the number of yarn layers. It is further preferred to wind the outermost yarn layer over both tapering end portions, to protectively cover the same.

Figure 5:
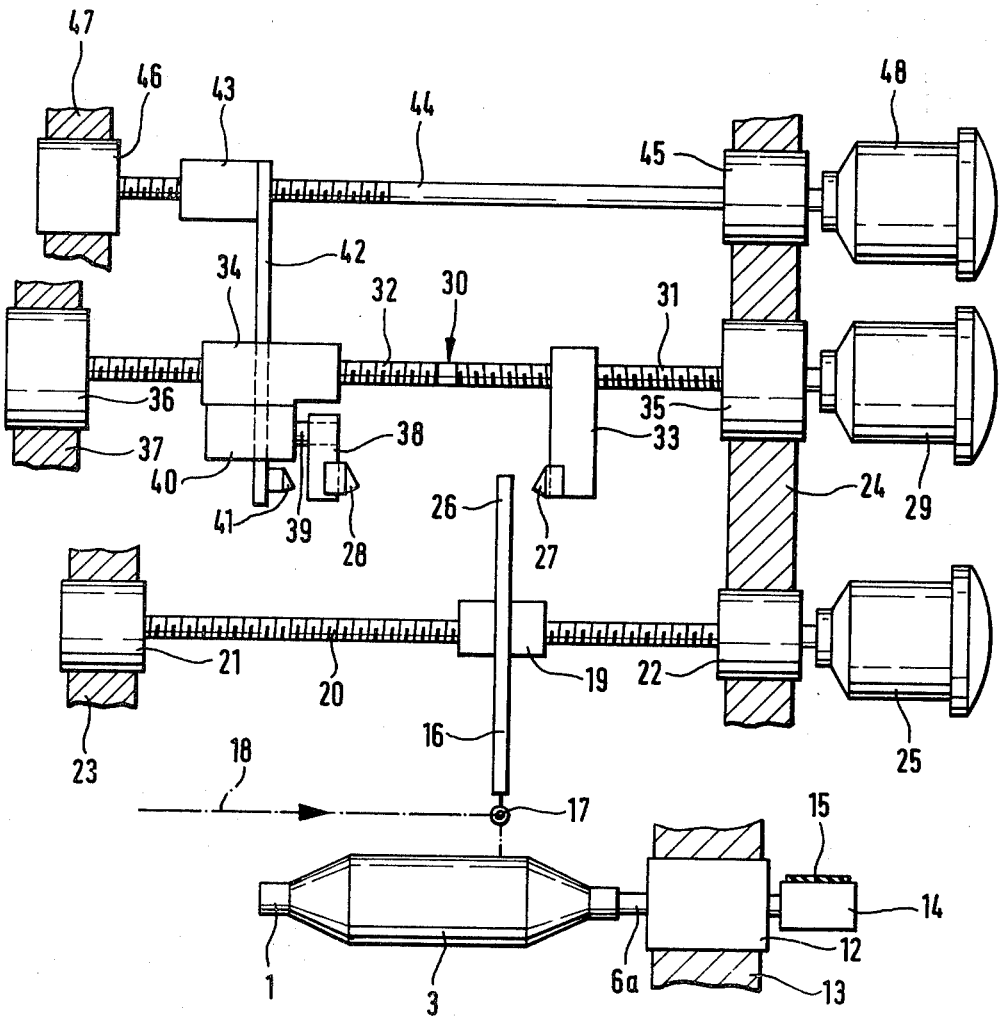
FIG. 5 is a schematic illustration of a winding apparatus for producing the yarn package in accordance with the present invention.

FIG. 5 schematically illustrates a winding apparatus in accordance with the present invention, and wherein a carrier 1 is coaxially mounted on a shaft *6a* so as to rotate therewith. The shaft *6a* is driven by a belt 15 via a whorl 14, and the shaft is mounted with its bearing 12 in a machine frame 13. A traversing yarn guide 17 winds a filament 18 on the carrier 1, and traverses in opposite directions along a direction parallel to the axis of the shaft *6a* in accordance with the function illustrated in FIG. 4. More particularly, traversing yarn guide 17 is mounted on an arm 16 which includes a nut 19 and a free end 26, with the nut 19 being threadedly mounted on a threaded spindle 20 which extends in a direction parallel to the shaft *6a*. The threaded spindle 20 is also mounted by means of bearings 21 and 22 in a machine frame 23 24, and is rotated by a reversible electric motor 25. The reversal of rotation of the motor 25, and thus the reversal of the traversing yarn guide 17, is controlled by limit switches 27 and 28, which are positioned to be acuated by the free end 26 of the arm 16. Limit switches 27 and 28 are electrically connected to the motor 25 and are arranged on spindle nuts or stops 33 and 34 respectively. The nuts 33 and 34 are in turn carried by a common spindle 30 which has oppositely directed threads 31 and 32, with the nut 33 being mounted on the portion 31 and the nut 34 being mounted on the portion 32. Spindle 30 is driven by a reversible electric motor 29, which is mounted in bearings 35 and 36 in the machine frame 24 and 37.

At least one of the limit switches 27 or 28 may be pivoted out of the path of travel of the free end 26 of the arm 16. In the illustrated embodiment, the switch 28 provides this function, and it is arranged in a holder 38 which is eccentrically mounted on the shaft 39 of a rotary magnet 40. Rotary magnet 40 is also mounted on the spindle nut 34. Limit switch 28 may for example be connected to a counter, which is designed to activate the rotary magnet 40 after a predetermined number of strokes has been counted. Thus the limit switch 28 may be moved, for example by rotating it 90 degrees about the shaft 39, out of the path of travel of the free end 26 of the arm 16. The free end 26 then is able to move further toward the left as shown, and until it comes in contact with another limit switch 41. The switch 41 thus replaces the switch 28, and also reverses the rotational direction of the electric motor 25. The limit switch 41 is mounted on an arm 42, which is carried by a spindle nut 43. The nut 43 is arranged on another threaded spindle 44, which in turn is mounted in bearings 45 and 46 in machine frame 24, 47, and is driven by the reversible electric motor 48. Electric motor 48, which preferably is a stepping motor, is controlled for example by the counter connected with the limit switch 28, and moves the limit switch 41 to the left in a direction to increase the traverse stroke by an amount at least equaling the diameter of the filament yarn, i.e., the amount c in FIG. 4. Limit switch 41 may also be connected with rotary magnet 40, so as to return the same to its initial operating position. The speed of shaft 6a, which may for example be 25,000 rpm, is thereby coordinated with the traverse speed of the yarn guide 17, so that a parallel wind of closely juxtaposed individual layers is produced.

In the drawings and specification, there has been set forth a preferred embodiment of the invention, and although specific terms are employed, they are used in a generic and descriptive sense only and not for purposes of limitation. For example, while the specification and claims refer to the outermost yarn layer, and to an extended intermediate layer, it will be understood that in each case more than on individual layer of yarn may be involved, such as two, three or more individual layers.

That which is claimed is:

1. A yarn package comprising a cylindrical yarn carrier having a yarn wound thereupon in layers, with at least the majority of the layers being of decreasing axial length as the distance from the carrier increases and so as to define a central cylindrical portion and opposite tapered end portions, the improvement wherein the outermost yarn layer extends over substantially the entire axial length of said central portion and at least one of said tapered end portions so as to protectively overlie the same, and wherein said package further includes a plurality of extended intermediate yarn layers which extend axially a distance sufficient to overlie substantially all of the underlying layers on said one tapered end portion.

2. The yarn package as defined in claim 1 wherein said extended intermediate yarn layers are regularly spaced apart.

3. The yarn package as defined claim 1 wherein each of said extended intermediate yarn layers extends axially beyond the end of the next adjacent underlying one of said extended intermediate layers, and so that each of said extended intermediate layers overlies and entirely covers the ends of the underlying layers on said one end portion.

4. The yarn package as defined in claim 3 wherein said outermost yarn layer extends axially beyond the end of the next adjacent underlying extended intermediate layer on said one end portion, and so that said outermost layer overlies and entirely covers all of the layers on said one end portion.

5. The yarn package as defined in claim 1 wherein said outermost yarn layer extends over substantially the entire axial length of said central portion and each of said tapered end portions.

6. The yarn package as defined in claim 1 wherein said yarn carrier is tubular to permit the package to be coaxially positioned on a mounting spindle or the like.

7. The yarn package as defined in claim 1 wherein said outermost yarn layer extends axially beyond the end of all of the underlying layers on said one end portion, and so that said outermost layer overlies and entirely covers all of the underlying layers on said one end portion.

8. A method of winding an advancing yarn onto a cylindrical yarn carrier to form a yarn package, and comprising the steps of rotating a cylindrical yarn carrier about a fixed axis, while traversing an advancing yarn axially along the carrier in opposite directions to form overlying yarn layers, with at least the majority of the layers being of decreasing axial length as the distance from the carrier increases and so as to form a central cylindrical portion and tapered end portions, and including traversing the advancing yarn which forms each of a plurality of spaced apart intermediate yarn layers to extend the length of such layers axially a distance sufficient to overlie substantially all of the underlying layers on at least one of said tapered end portions, and traversing the yarn forming the outermost yarn layer axially over substantially the entire length of said central portion and said at least one of said tapered end portions so that the outermost yarn layer protectively overlies such one end portion.

9. The method as defined in claim 8 wherein the traversing step further includes progressively increasing the axial length of each of the said extended intermediate yarn layers so that each of said extended intermediate yarn layers extends axially beyond the end of the next adjacent underlying one of said extended intermediate layers, and so that each of said intermediate layers overlies and entirely covers the ends of the underlying layers on said one end portion.

10. The method as defined in claim 9 wherein the axial length of each of said extended intermediate yarn layers is extended a distance beyond the next adjacent underlying one of said extended intermediate layers which is at least approximately equal to the diameter of the yarn being wound.

11. The method as defined in claim 10 wherein the axial length of said outermost yarn layer is extended axially beyond the end of the next adjacent underlying one of said extended intermediate layers, and so that said outermost layer overlies and entirely covers all of the layers on said one end portion.

12. An apparatus for winding an advancing yarn onto a cylindrical yarn carrier to form a yarn package, and comprising means for supporting a cylindrical yarn carrier for rotation about a fixed axis, means for rotating said carrier about said axis, means for traversing an advancing yarn axially along said carrier in opposite directions to form overlying yarn layers, with at least the majority of the layers being of decreasing axial length as the distance from the carrier increases and so as to form a central cylindrical portion and tapered end portions, said traversing means including a thread guide, means for traversing said thread guide in opposite directions along a direction parallel to said fixed axis, first and second stops mounted for movement toward and away from each other along a direction parallel to said fixed axis, with each of said stops including switch means for controlling the direction of said traversing means, and with said stops being positioned for engagement by the traversing thread guide so as to actuate the switch means and thereby reverse the traversing direction, and means for progressively moving said first and second stops toward each other during the winding operation, said traversing means further including control means for traversing the yarn forming the outermost yarn layer axially over substantially the entire length of said central portion and at least one of said tapered end portions so that the outermost yarn layer protectively overlies such one end portion, said control means including a third stop mounted for movement along a direction parallel to said fixed axis, with said third stop including switch means for controlling the direction of said traversing means, and with said third stop being disposed axially outside of said first and second stops and adjacent said second stop, and means for periodically laterally moving said second stop so that the traversing thread guide is adapted to move axially beyond said second stop and engage said switch means of said third stop.

13. The apparatus as defined in claim 12 wherein said control means further includes means for progressively moving said third stop along a direction parallel to said fixed axis.

* * * * *